United States Patent [19]

Yano et al.

[11] 3,953,813

[45] Apr. 27, 1976

[54] ELECTROMAGNETIC SWITCH MATRIX DEVICE

[75] Inventors: Norio Yano, Fussa; Seiei Okoshi, Kawasaki; Sadayuki Mitsuhashi; Norio Suzuki, both of Tokyo, all of Japan

[73] Assignees: Nippon Telegraph & Telephone Public Corporation; Nippon Electric Company, Limited, both of Tokyo, Japan

[22] Filed: June 19, 1974

[21] Appl. No.: 480,809

[30] Foreign Application Priority Data

June 20, 1973 Japan ..... 48-68655

[52] U.S. Cl. ..... 335/112; 200/175

[51] Int. Cl.[2] ..... H01H 67/14

[58] Field of Search ..... 335/112, 111; 200/175

[56] References Cited

UNITED STATES PATENTS

| | | | |
|---|---|---|---|
| 3,464,039 | 8/1969 | Takamura et al. | 335/112 |
| 3,487,344 | 12/1969 | Takamura et al. | 335/112 |

*Primary Examiner*—G. Harris

*Attorney, Agent, or Firm*—Sughrue, Rothwell, Mion, Zinn & Macpeak

[57] ABSTRACT

An electromagnetic matrix switch device, suitable for use in an automatic exchange or computer, comprising a two-dimensional array of cross-point elements, each of which comprises a magnetically actuated switch adapted to bridge its associated pair of row and column signal lines and a magnetic core positioned in magnetically-coupled relationship to the switch to actuate it in response to a current pulse applied to its associated pair of row and column control lines. Each magnetic core has provided therearound first and second windings connected to its associated row control line and third and fourth windings connected to its associated column control line, the polarity of those windings being such that application of the current pulse to the row and column control lines will cause the first and fourth windings to produce magnetic fields in a direction opposite to those produced by the second and third windings. Provision is made for short-circuiting the second and third windings of each magnetic core simultaneously with the application of the current pulse to a selected pair of the control lines, whereby only the magnetic core located at the intersection of the selected pair of the control lines produces a magnetic field sufficient to actuate its associated switch.

14 Claims, 18 Drawing Figures

FIG. 9
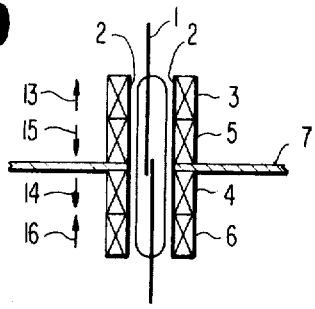
FIG. 10
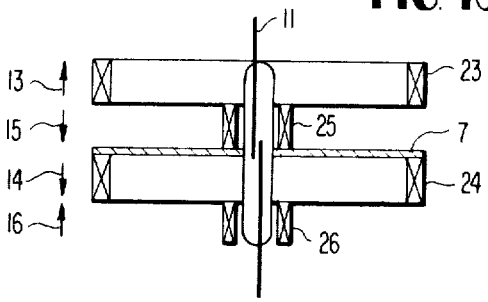
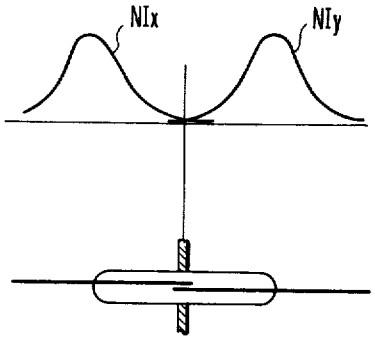
FIG. 11a
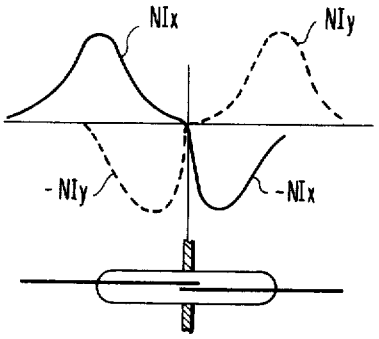
FIG. 11b
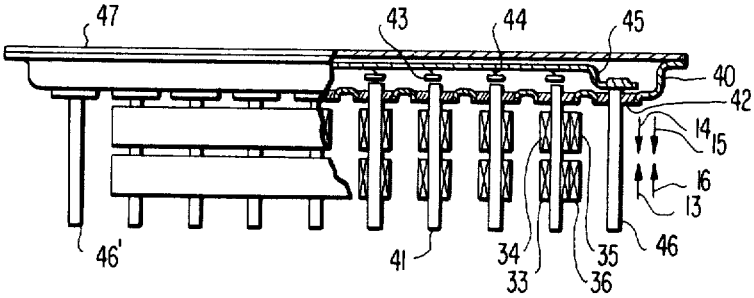
FIG. 12

ELECTROMAGNETIC SWITCH MATRIX DEVICE

BACKGROUND OF THE INVENTION

The present invention relates to an electromagnetic switch matrix device for use in automatic exchanges, hybrid electronic computers and the like.

Generally, in known of electromagnetic switch matrix devices, by selectively applying a current pulse to a row control line and a column control line, magnetic cores which are easily reversible in magnetization and capable of retaining residual magnetization, are controlled so that a magnetically responsive switching element located at a cross point between a row signal line corresponding to said row control line and a column signal line corresponding to said column control line may be closed to connect said row signal line to said column signal line.

In this case, at each cross-point where the row signal line and the column signal line intersect at right angles to each other, there are provided a plurality of excitation windings for electromagnetically controlling said switching element, which windings are connected to the corresponding row control line or to the corresponding column control line. In order to select and close a particular switching element, a current pulse is applied to the corresponding row control line and the corresponding column control line to energize the excitation windings, and thereby the switching element is closed.

However, in the above-described construction, in which the switching element is selected by logical coincidence of the directions of the applied magnetic fields, the total magneto-motive force applied upon selection of the switching element would become fairly large in comparison with the magneto-motive force required for closing the switching element, because two sets of the excitation windings arranged along the row and the column are simultaneously energized. Accordingly, the impedance of the windings would be very high, and the driving electric power would be also large.

In addition, the switching elements are adapted to be released if the excitation winding or windings belonging to only one of the associated row and column control lines are energized. Therefore, when the switching element at a particular cross-point is actuated to close its contact points, all the switching elements located at the other cross-points on the same row and on the same column are automatically released, and so it is difficult to realize multiple connection of the switching elements located on the same row or on the same column.

Furthermore, in such prior art switch matrix devices, it is a common practice to provide, as the excitation windings for each switching element, two pairs of windings having different numbers of turns and different directions of turns from each other, each pair being connected to one of the row and column control lines. Accordingly, owing to the excitation windings having a large number of turns, the magnetic interference between adjacent rows or between adjacent columns becomes large, so that the spacing of the cross-points is inevitably large.

SUMMARY OF THE INVENTION:

Therefore, it is one object of the present invention to provide an electromagnetic switch matrix device which has a low winding impedance and a small driving electric power.

Another object of the present invention is to provide an electromagnetic switch matrix device in which multiple connections can be achieved.

Still another object of the present invention is to provide an electromagnetic switch matrix device in which the magnetic interference between cross-points in the adjacent rows or in the adjacent columns is small.

According to one feature of the present invention, an electromagnetic switch matrix comprises a plurality of row signal lines; a plurality of column signal lines intersecting substantially at right angles to said row signal lines; a plurality of electromagnetic switching elements disposed at the respective cross-points between said row and column signal lines, so as to bridge across the corresponding row and column signal lines when their contact points are electromagnetically closed; first, second, third and fourth winding means wound around said electromagnetic switching elements so as to generate control magnetic fields for controlling the operations of the respective switching elements; a plurality of row control lines corresponding to said respective row signal lines, each of which includes said first winding means for generating control magnetic fields in common to all the cross-points aligning on the corresponding row as well as said second winding means for generating magnetic fields in common to all the cross-points aligning on the corresponding row; a plurality of column control lines corresponding to said respective column signal lines, each of which includes said third winding means for generating magnetic fields in common to all the cross-points aligning on the corresponding column as well as said fourth winding means for generating magnetic fields in common to all the cross-points aligning on the corresponding column; and means for selectively short-circuiting said second winding means and said third winding means at least in a selected row control line and in a selected column control line, respectively; said first, second, third and fourth winding means being wound and connected in the row control line or in the column control line with such polarity that when a predetermined polarity of current pulse is passed through said row and column control lines, said second and third winding means may generate control magnetic fields in the opposite direction to that generated by said first winding means, while said fourth winding means may generate a control magnetic field in the same direction as that generated by said first winding means.

BRIEF DESCRIPTION OF THE DRAWINGS:

The above-mentioned and other features and objects of this invention will become more apparent by reference to the following description taken in conjunction with the accompanying drawings, in which:

FIG. 9 is a cross-section view showing the structure of a cross-point unit to be employed in electromagnetic switch matrix device according to the present invention, FIG. 10 is a cross-section view showing the structure of a modified cross-point to be employed in the electromagnetic switch matrix device according to the present invention, FIG. 11*a* is a diagram showing the magnetic field distribution generated by the excitation windings upon closing a switching element, FIG. 11*b* is a diagram of the magnetic field distribution generated by the excitation windings upon releasing the switching element, and FIG. 12 is a side view partially in cross-section of a modified structure of the electromagnetic switch matrix device according to the present invention.

DESCRIPTION OF THE PREFERRED EMBODIMENTS:

Now the invention will be described with reference to the drawings.

Figure 1:
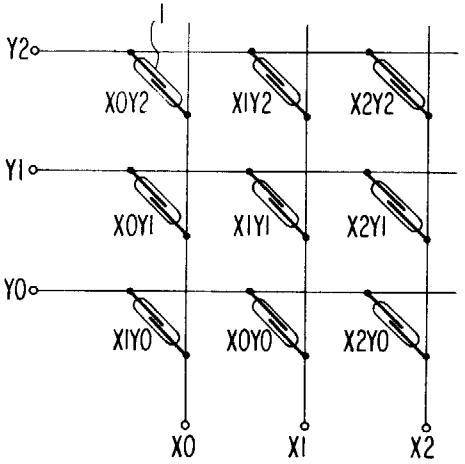
FIG. 1 PRIOR ART
FIG. 1 is a wiring diagram of a signal line section in an electromagnetic switch matrix device of the prior art.

Referring now to FIG. 1 which shows the conventional electromagnetic switch matrix device, the signal line section comprises row signal lines $Y_o$, $Y_1$ and $Y_2$ arranged in parallel to each other, and column signal lines $X_o$, $X_1$ and $X_2$ arranged so as to intersect with the row signal lines substantially at right angles thereto. At the cross-points $X_oY_o$, $X_oY_1$, . . . $X_2Y_1$, $X_2Y_2$ where the respective signal lines intersect with each other, are disposed switching elements 1 which can respond magnetically to bridge the respective signal lines.

Figure 2:
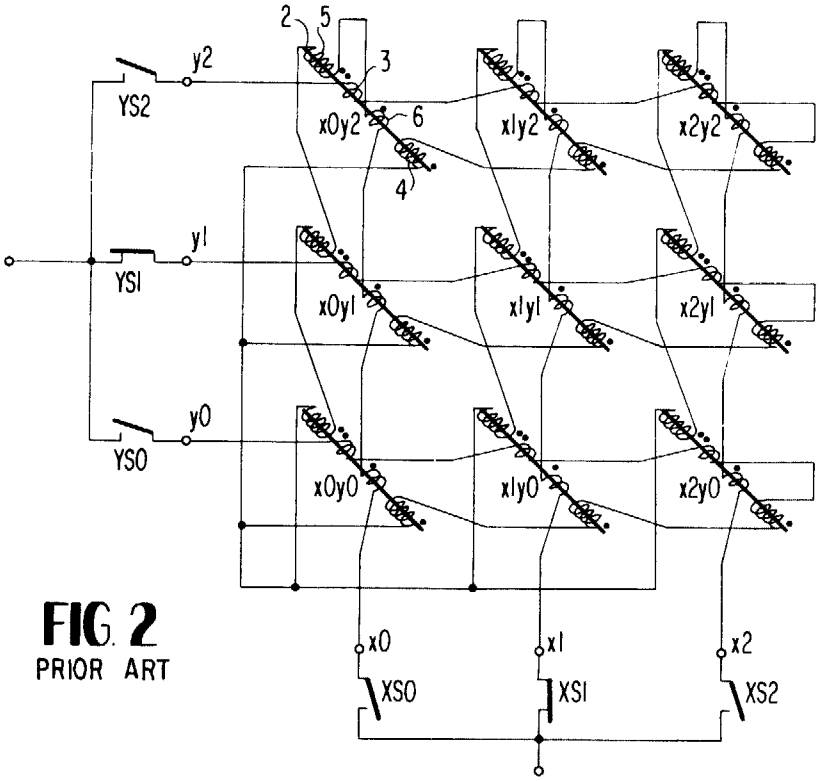
FIG. 2 PRIOR ART
FIG. 2 is a wiring diagram of a control line section in the prior art electromagnetic switch matrix device.

Referring now to FIG. 2 which also shows the conventional switch matrix device, the control line section comprises row control lines $y_o$, $y_1$ and $y_2$ provided in correspondence to the row signal lines $Y_o$, $Y_1$ and $Y_2$, and column control lines $x_o$, $x_1$ and $x_2$ provided in correspondence to the column signal lines $X_o$, $X_1$ and $X_2$. In addition, at the cross-points $x_oy_o$, $x_oy_1$, . . . $x_2y_1$, $x_2y_2$ where the row control lines and the column control lines intersect with each other are disposed magnetic cores 2 which are magnetically coupled to the respective switching elements 1 shown in FIG. 1, easily reversible in magnetization and capable of retaining residual magnetization. The respective row control lines $y_o$, $y_1$ and $y_2$ are connected to row control switches $YS_o$, $YS_1$ and $YS_2$, respectively, while the respective column control lines $x_o$, $x_1$ and $x_2$ are connected to column control switches $XS_o$, $XS_1$ and $XS_2$, respectively.

As will be explained in more detail, to the respective row control lines $y_o$, $y_1$ and $y_2$ are serially connected first excitation windings 3 and second excitation windings 4 having a number of turns twice as many as that of said first excitation windings 3, which are associated with all the cross-points belonging to the corresponding rows. On the other hand, to the respective column control lines $x_o$, $x_1$ and $x_2$ are serially connected third excitation windings 5 having a number of turns equal to that of said second excitation windings 4 and fourth excitation windings 6 having a number of turns equal to that of said first excitation windings 3, which are associated with all the cross-points belonging to the corresponding columns. The polarity of the turns and the connection of the first, second, third annd fourth windings at the respective cross-points are such that upon passing a current pulse between the row control switches and the column control switches via the common junction point, the second and third excitation windings 4 and 5 may generate control magnetic fields for the switching element 1 in the opposite direction to that generated by the first excitation winding 3, while the fourth excitation winding 6 may generate a control magnetic field for the switching element 1 in the same direction as that generated by the first excitation winding 3.

Figure 3A:
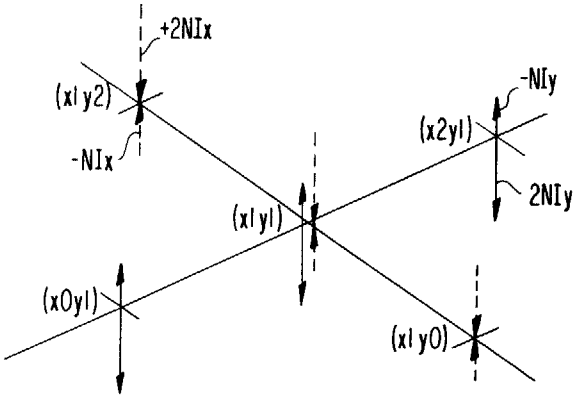
FIG. 3a PRIOR ART
FIG. 3*a* is a schematic view perspectively showing the state of control magnetic fields at the respective cross-points in case that a particular cross-point switch is closed in the prior art electromagnetic switch matrix device.
Figure 3B:
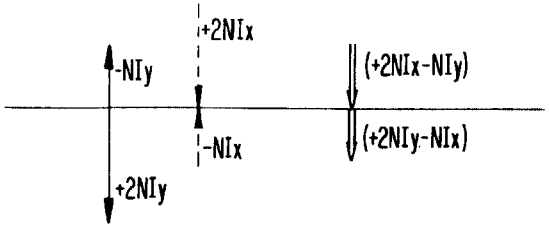
FIG. 3b PRIOR ART
FIG. 3*b* is a schematic view showing the state of control magnetic fields at the particular cross-point.

FIG. 3 is a schematic view for explaining the operation of the prior art electromagnetic switch matrix device as shown in FIGS. 1 and 2, in which is illustrated the state of the control magnetic fields at the relevant cross-points occurring when the row control switch $YS_1$ and the column control switch $XS_1$ are simultaneously closed to pass a current pulse from the row control switch $YS_1$ through the row control line $y_1$ and the column control line $x_1$ to the column control switch $XS_1$. Then, the first, second, third and fourth excitation windings 3, 4, 5 and 6 disposed at the respective cross-points are energized as shown by the arrows in FIG. 3*a*. Particularly, at the cross-point $x_1y_1$, the control magnetic fields in the upper and lower sections act additively as shown in FIG. 3*b*, and thereby the switching element 1 disposed at the corresponding cross-point $X_1Y_1$ of the signal line section is closed to connect the row signal line $Y_1$ and the column signal line $X_1$ with each other.

On the other hand, at the remaining relevant cross-points $x_oy_1$, $x_2y_1$, $x_1y_o$ and $x_1y_2$ where the control current pulse is applied only to one of the row and column control lines, the control magnetic fields in the upper and lower sections are oppositely directed, and thereby the switching elements 1 disposed at the corrsponding cross-points $X_oY_1$, $X_2Y_1$, $X_1Y_o$ and $X_1Y_2$ of the signal line section are not closed, or are released if they have been closed up to this time. Since, as described above, the previously closed switching element 1 which is located on the same row or on the same column as the switching element 1 to be newly closed is automatically released, multiple connection of two or more switching elements located on the same row or on the same column is difficult to realize.

Figure 4:
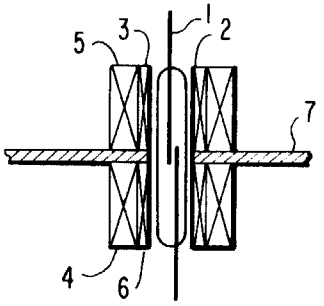
FIG. 4 PRIOR ART
FIG. 4 is a longitudinal cross-section view showing the structure of a cross-point switch in the prior art electromagnetic switch matrix.

FIG. 4 is a longitudinal cross-section view showing the structure of each cross-point in the prior art electromagnetic switch matrix device. In this figure, a switching element 1 which is made of soft magnetic material and capable of connecting a row signal line and a column signal line is disposed within a magnetic core 2 made of semi-hard magnetic material, and around the outer periphery of the magnetic core 2 are wound a first excitation winding 3, a second excitation winding 4, a third excitation winding 5 and a fourth excitation winding 6. In addition, between the first and third excitation windings 3 and 5 and the second and fourth excitation windings 4 and 6 is disposed a magnetic shunt plate 7.

In the above-described electromagnetic switch matrix device, upon selecting one switching element at a particular cross-point, since the selection is made as a result of logical coincidence of the directions of the control magnetic fields, all the excitation windings connected in the relevant row and column control lines are simultaneously energized. Accordingly, in the case of the example shown in FIG. 2, assuming that the number of turns of the first and fourth excitation windings 3 and 6 is equal to N and that the number of turns of the second and third excitation windings 4 and 5 is equal to 2N, the total number of turns amounts to a large number such as $N \times 6 + 2N \times 6 = 18N$, which results in a high winding impedance, and so the driving electric power is also increased. Furthermore, since the number of turns of the second and third excitation windings is twice as large as that of the first and fourth excitation windings, the magnetomotive force produced by the former windings is so large that a great magnetic interference is acted upon the adjacent rows and columns, and consequently, the pitch of the cross-point array must be made relatively large.

Figure 5:
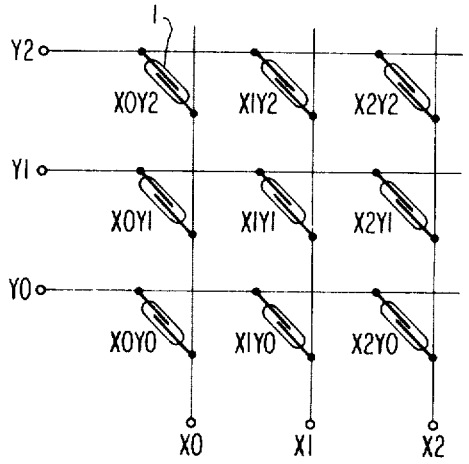
FIG. 5 is a wiring diagram of a signal line section in an electromagnetic switch matrix device according to the present invention.
Figure 6:
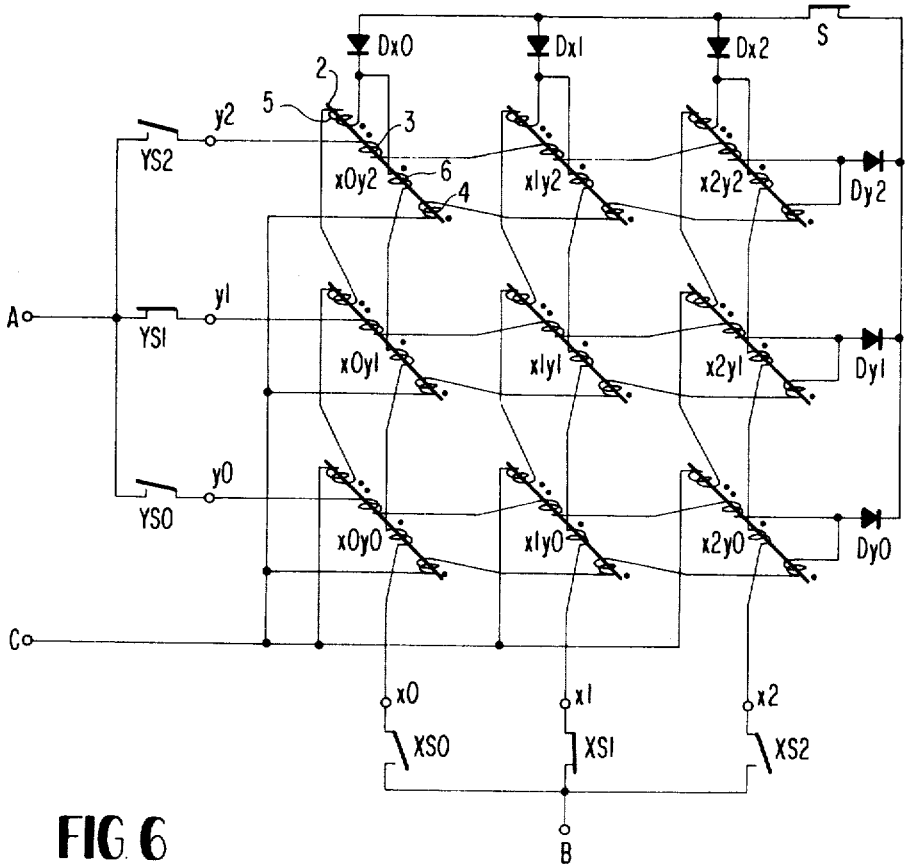
FIG. 6 is a wiring diagram of a control line section in the electromagnetic switch matrix device according to the present invention.

FIGS. 5 and 6 are schematic views illustrating one preferred embodiment of the present invention, FIG. 5 showing the signal line section corresponding to FIG. 1, and FIG. 6 showing the control line section.

Referring now to FIG. 6, there are provided row control lines $y_o$, $y_1$ and $y_2$ corresponding to row signal lines $Y_o$, $Y_1$ and $Y_2$, respectively, and column control lines $x_o$, $x_1$ and $x_2$ corresponding to column signal lines $X_o$, $X_1$ and $X_2$, respectively, and at the cross-points between these row and column control lines are disposed cross-point switches each of which includes a switching element 1 and a magnetic core 2. In addition, the respective row and column control lines $y_o \sim y_2$ and $x_o \sim x_2$ are connected at one end to terminals A and B, respectively, through row control switches $YS_o \sim YS_2$ and column control switches $XS_o \sim XS_2$, respectively. It is to be noted that instead of employing the magnetic core 2, a switching element having a magnetic self-holding function can be used. The other ends of all the row and column control lines $y_o \sim y_2$ and $x_o \sim x_2$ are jointed together and connected together to a common terminal C.

Around the outer periphery of the respective magnetic core 2 are wound first and second excitation windings 3 and 4 connected in common to the respective row control lines $y_o \sim y_2$, and third and fourth excitation windings 5 and 6 connected in common to the respective column control lines $x_o \sim x_2$. The numbers of turns of the first, second, third and fourth windings are substantially equal to each other. The polarity of the turns and the connection of the first, second, third and fourth windings at the respective cross-points are such that upon passing a current pulse between the terminals A and B through the row control switches $YS_o \sim YS_2$, the row control lines $y_o \sim y_2$, the common conductor connected to the terminal C, the column control lines $x_o \sim x_2$ and the column control switches $XS_o \sim XS_2$, the second and third excitation windings 4 and 5 may generate control magnetic fields for the switching element 1 in the opposite direction to that generated by the first excitation windings 3, while the fourth excitation winding 6 may generate a control magnetic field for the switching element 1 in the same direction as that generated by the first excitation winding 3.

The aforementioned first to fourth windings 3~6 are wound around the switching element 1 at specific positions relative to the switching element 1 as will be described later with reference to FIGS. 9 and 10.

Alternatively, the selective short-circuiting means can be realized by replacing individual on-off switches for the respective diode $Dy_o \sim Dy_2$ and $Dx_o \sim Dx_2$ and directly connecting the above-referred first and second common conductors without employing the short-circuiting switch S.

Figure 7A:
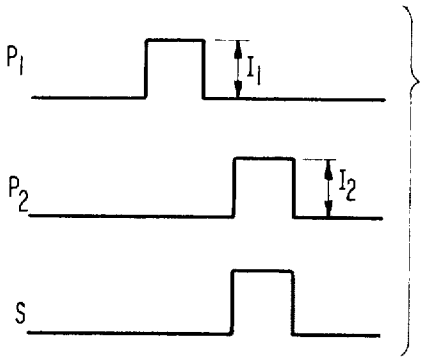
FIGS. 7*a* through 7*d* are diagrammatic views for explaining the operation principle of the present invention, FIGS. 7*a* and 7*b* showing the timing relation between a control current pulse and actuation of a short-circuiting switch, and FIGS. 7*c* and 7*d* showing the state of control magnetic fields occurring at relevant cross-points when the control current pulse is applied.
Figure 7B:
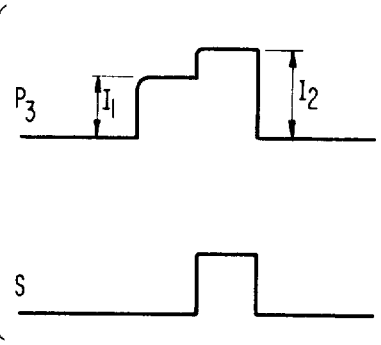
Figure 7C:
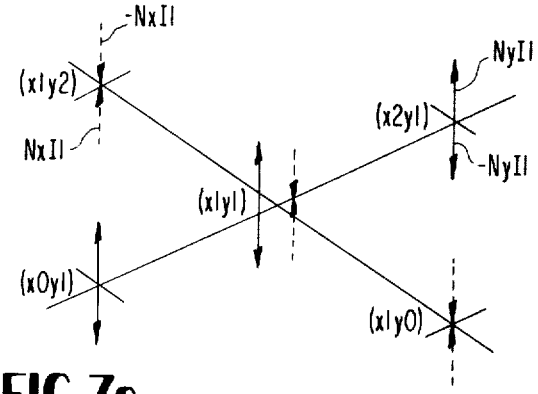

Now the operation of the electromagnetic switch matrix device according to the present invention as illustrated in FIGS. 5 and 6 will be described with reference to FIG. 7. In the following description, it is assumed that the current pulses $P_1$ and $P_2$ shown in FIG. 7*a* are applied between the terminals A and B in FIG. 6 so that a current may flow from the terminal A to the terminal B, and that the short-circuiting switch S in FIG. 6 is closed for a short period of time at a predetermined timing relation to the current pulses $P_1$ and $P_2$ as represented by a waveform S. However, it is to be noted that the same operation can be realized by means of the current pulse $P_3$ to be applied between the terminals A and B and the actuation waveform S of the short-circuiting switch represented in FIG. 7*b*. FIG. 7*c* shows the state of the control magnetic fields occurring at the respective cross-points when the row control switch $YS_1$ and the column control switch $XS_1$ are simultaneously closed and the current pulse $P_1$ is applied between the terminals A and B so that the current may flow from the terminal A to the terminal B. At this moment of time, the terminal C is kept floating. Then, at the cross-points $x_oy_1$ and $x_2y_1$ where the first excitation windings 3 and the second excitation windings 4 connected to the row control line $y_1$ are energized, control magnetic fields proportional to magnetomotive forces $NyI_1$ and $-N\,yI_1$, respectively, are applied to the upper and lower portions of the switching element 1, where $Ny$ represents the number of turns of each of the first and second excitation windings and $I_1$ represents the magnitude of the current pulse $P_1$ in FIG. 7*a*. Also at the cross-points $x_1y_o$ and $x_1y_2$ where the third excitation windings 5 and the fourth excitation windings 6 connected to the column control line $x_1$ are energized, control magnetic fields proportional to magnetomotive forces $-NxI_1$ and $NxI_1$, respectively, are applied to the upper and lower portions of the switching element 1, where $Nx$ represents the number of turns of each of the third and fourth excitation windings. In the following description and the accompanying drawings, for simplicity of explanation, the control magnetic fields themselves are represented by $NyI_1$, $-NyI_1$, $-NxI_1$ and $NxI_1$, respectively. As described above, since the control magnetic fields having equal magnitudes and opposite directions are applied to the upper and lower portions of the switching elements 1 at the cross-points $x_oy_1$, $x_2y_1$, $x_1y_o$ and $x_1y_2$, the contact points of these switching elements are released.

At the selected cross-point $x_1y_1$, apparently all the first, second, third and fourth windings 3 to 6 are simultaneously energized, and therefore as shown in FIG. 7*c*, in the upper and lower portions of the switching element 1 the applied control magnetic fields are offset, resulting in no effect upon the switching element at the cross-point $x_1y_1$.

Subsequently, when the short-circuiting switch S is closed and simultaneously the current pulse $P_2$ is applied between the terminals A and B so that the current may flow from the terminal A to the terminal B, a current flows for a short period of time along the following path: terminal A—$YS_1$—first excitation windings 3—$Dy_1$—S—$Dx_1$—fourth excitation windings 6—$XS_1$—terminal B. In other words, at this moment the second and third excitation windings 4 and 5 are short-circuited in contrast to the preceding case of applying the current pulse $P_1$ with the switch S kept opened.

Figure 7D:
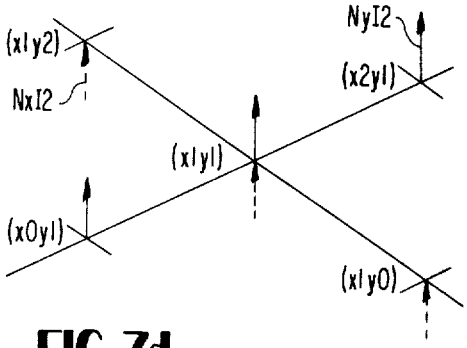

FIG. 7*d* shows the state of control magnetic fields occurring at the respective cross-points when the current pulse $P_2$ is applied with the switch S closed. In this figure, at the cross-points $x_oy_1$, $x_1y_1$ and $x_2y_1$ where the first excitation windings 3 connected to the row control line $y_1$ are energized, control magnetic fields $NyI_2$ are generated in the upper portions of the switching elements 1, while at the cross-points $x_1y_o$, $x_1y_1$ and $x_1y_2$ where the fourth excitation windings 6 connected to the column control line $x_1$ are energized, control magnetic fields $NxI_2$ are generated in the lower portions of the switching elements 1. As a result, at the selected cross-point $x_1y_1$, the control magnetic fields $NyI_2$ and $NxI_2$ in the upper and lower portions of the switching element 1 act additively to close the switching contacts located at the cross-point $X_1Y_1$ between the row signal line $Y_1$ and the column signal line $X_1$. However, at the so-called "half-selected" cross-points $x_oy_1$, $x_2y_1$, $x_1y_o$ and $x_1y_2$, the control magnetic fields of only $NyI_2$ or only $NxI_2$ in the upper or lower portion of the switching element 1 are not sufficient to actuate the switching elements 1 located at these cross-points.

Since the control line arrangement according to the present invention is constructed as described above, the total number of turns of the windings to be energized for closing a switching element located at a particular cross-point, is equal to $N \times 6 \times 2 = 12N$ (See FIG. 7*c*) upon applying the pulse $P_1$, and equal to $N \times 3 \times 2 = 6N$ (See FIG. 7*d*) upon applying the pulse $P_2$, these total numbers of turns being ⅔ times and ⅓ times, respectively, as small as the number of turns in the case of the prior art device, that is equal to $(N \times 3 + 2N \times 3) \times 2 = 18N$ (See FIG. 3), whereby the impedance of the excitation windings is lowered. Accordingly, the driving electric power is reduced, and the driving power supply voltage is also reduced to ⅔ times as high as that of the prior art device, so that the circuit design of the power supply when applied to a multi-stage switch matrix connection is facilitated.

In addition, since the numbers of turns of the first to fourth excitation windings are equal to each other, and since in any case the upper or lower half portion of the cross-point switch is excited by a winding having a number of turns equal to only N, the magnetomotive force produced by the winding is so small that the magnetic interference acted upon the adjacent cross-points can be minimized. Accordingly, the pitch of the cross-point arrangement can be made relatively small, and thus it is possible to reduce the size of the switch matrix device.

Figure 8A:
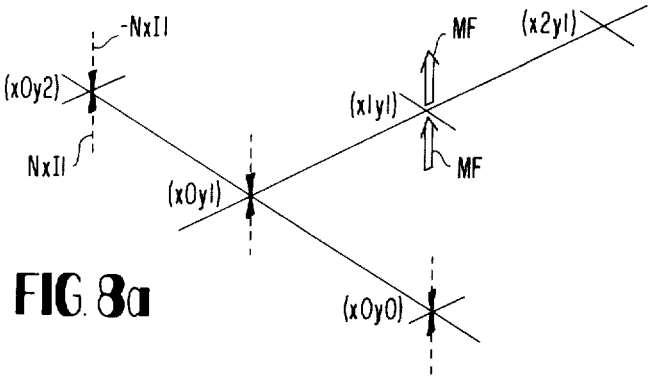
FIGS. 8*a* and 8*b* are diagrammatic views for explaining the operation of multiple connection, FIG. 8*a* showing the state of control magnetic fields occurring at relevant cross-points upon preliminarily resetting the column to be additionally connected, and FIG. 8*b* showing the state of control magnetic fields at the relevant cross-points upon completing the multiple connection.

FIG. 8 is a schematic view for explaining the operations for multiple connection, in which the already closed cross-point switch located at the cross-point $x_1y_1$ is magnetized in the direction of arrow MF. Now the operations of making multiple connection at the cross-point $x_oy_1$ will be described. In the first step illustrated in FIG. 8*a*, a current pulse $P_1$ is applied between the terminals C and B in FIG. 6 so that a current may flow from the terminal C to the terminal B. Then, only the column control switch $XS_o$ is closed with the short-circuiting switch S kept opened. Accordingly, the current flows only through the column control line $x_o$ including the third excitation windings 5 and the fourth excitation windings 6, which windings are then energized to generate control magnetic fields equal to $-NxI_1$ and $NxI_1$, respectively, in the upper and lower portions of the switch elements 1 at the cross-points $x_oy_o$, $x_oy_1$ and $x_oy_2$ as shown in FIG. 8*a*.

Figure 8B:
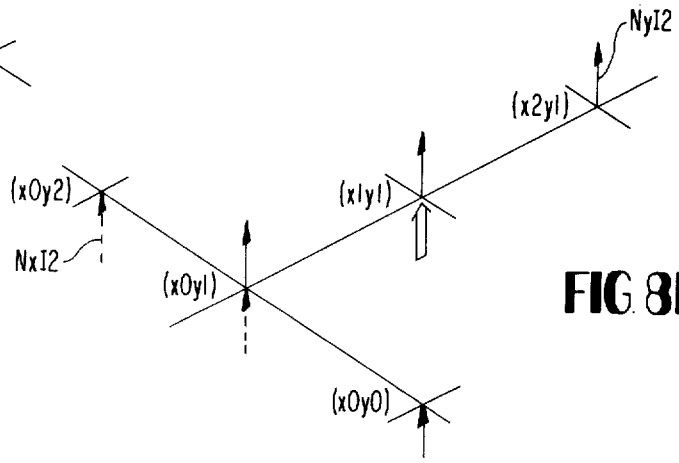

Subsequently, in the second step of operation illustrated in FIG. 8*b*, a current pulse $P_2$ is applied between the terminals A and B in FIG. 6 so that a current may flow from the terminal A to the terminal B. Then the row control switch $YS_1$, the column control switch $XS_o$ and the short-circuiting switch S are simultaneously closed. Since the second and third excitation windings 4 and 5 are short-circuited through the circuit including the diodes $Dy_o$~$Dy_2$ and $Dx_o$~$Dx_2$ and the short-circuiting switch S as well as the common conductor connected to the terminal C, the current pulse flows through the first excitation windings 3 in the row control line $y_1$ and the fourth excitation windings 6 in the column control line $x_o$. Accordingly, these excitation windings 3 and 6 are energized to generate control magnetic fields $NyI_2$ and $NxI_2$, respectively, in the upper and lower portions of the switching elements at the relevant cross-points $x_oy_o$, $x_oy_1$, $x_oy_2$, $x_1y_1$ and $x_1y_2$ as shown in FIG. 8*b*. As a result, at the cross-point $x_1y_1$ where, the switching element 1 is kept magnetized to be closed as indicated by an arrow MF in FIG. 8*b*, since that cross-point switch was firstly actuated in the previous operations as shown in FIGS. 7*c* and 7*d*, the same switching element 1 can be further kept magnetized to be closed. At the newly selected cross-point $x_oy_1$, the control magnetic fields $NyI_2$ and $NxI_2$, respectively, in the upper and lower portion of the switching element 1 act additively to close the contact points. However at the remaining "half-selected" cross-points $x_oy_o$, $x_oy_2$ and $x_1y_2$, the control magnetic field $NyI_2$ or $NxI_2$ singly is insufficient to newly actuate the cross-point switches. Thus the desired multiple connection between the row signal line $Y_1$ and the column signal lines $X_o$ and $X_1$ through the switching elements 1 located at the cross-points $X_oY_1$ and $X_1Y_1$, has been established.

A more detailed structure of the cross-point switch in the electromagnetic switch matrix device according to the present invention is shown in FIG. 9, in which reference numeral 1 designates a switching element made of soft magnetic material, numeral 2 designates a magnetic core made of semi-hard magnetic material, numeral 3 designates a first excitation winding disposed outside of a third excitation winding 5, and numeral 6 designates a fourth excitation winding disposed outside of a second excitation winding 4, a magnetic shunt plate 7 being interposed between the first and third excitation windings 3 and 5 and the second and fourth excitation windings 4 and 6. In case of closing the switching element 1, the second excitation winding 4 and the third excitation winding 5 are short-circuited through the selective short-circuiting means including the short-circuiting switch S as described above, and the magnetic core 2 is magnetized by the first excitation winding 3 as shown by an arrow 13, and also magnetized by the fourth excitation winding 6 as shown by an arrow 16 so that these effects of magnetization of the magnetic core 2 may additively act upon the switching element 1 to close its contact points. On the other hand, in case of releasing the switching element 1, the magnetic core 2 is magnetized either by the first excitation winding 3 and the second excitation winding 4 connnected in the row control line in the opposite directions to each other as shown by arrows 13 and 14, respectively, or by the third excitation winding 5 and the fourth excitation winding 6 connected in the column control line in the opposite directions to each other as shown by arrows 15 and 16, respectively, and thereby the contact points of the switching element 1 is released.

A modified embodiment of the cross-point switch to be used in the electromagnetic switch matrix device according to the present invention is illustrated in FIG. 10. This embodiment is different from the first embodiment shown in FIG. 9 in the arrangement of the magnetic self-holding means and the excitation winding means. As to the magnetic self-holding means, instead of employing the magnetic core 2 made of semi-hard magnetic material in combination with the switching element 1 made of soft magnetic material, a switching element 11 made of semi-hard magnetic material which can retain residual magnetization is employed solely and the magnetic core is omitted. With regard to the excitation winding means, in contrast to the first embodiment shown in FIG. 9 in which the first to fourth windings are individually wound around each switching element 11, a first excitation winding 23 and a second excitation winding 24 to be connected to the row control line are wound in common to all the switching elements 11 arrayed in each row of the switch matrix, that is, each of the first and second excitation windings is wound in the form of a single loop surrounding all the switching elements 11 arrayed in a row. Similarly, a third excitation winding 25 and a fourth excitation winding 26 are wound in common to all the switching elements 11 arrayed in each column of the switch matrix. Although only one switching element 11 is shown in FIG. 10 for simplicity of illustration, it will be readily appreciated that the switching elements 11 are arrayed in three rows and three columns in a plane perpendicular to the sheet of the drawing and three sets of first to fourth elongated excitation windings 23 to 26 are disposed correspondingly along the same plane to form an electromagnetic switch matrix equivalent to that shown in FIG. 6. In addition, similarly to the embodiment in FIG. 9, a shunt magnetic plate 7 is interposed between the first and third excitation windings 23 and 25 and the second and fourth windings 24 and 26. It will be obvious that the commonly wound excitation windings 23 to 26 shown in FIG. 10 can achieve the same function as the individually wound excitation windings 3 to 6. Therefore, the operations of closing and releasing the switching elements 11 in FIG. 10 are carried out exactly in the same way as those described in connection to the cross-point switch shown in FIG. 9. That is, by selectively energizing some of the first to fourth excitation windings 23 to 26 in combination, a proper combination of control magnetic fields as shown by arrows 13 to 16 is generated in the upper and lower portions of the switching element 11 to cause the contact points in the switching element to close or to release.

FIG. 11 shows a distribution of the magnetic field generated by the excitation windings at the cross-point of the electromagnetic switch matrix device according to the present invention. FIG. 11*a* shows a distribution of the magnetic field generated upon closing the switching element 1 or 11, in which a control magnetic field NI*y* is generated by the first excitation winding and a control magnetic field NI*x* is generated by the fourth excitation winding. FIG. 11*b* shows a distribution of the magnetic field generated upon releasing the switch element 1 or 11, in which a control magnetic field NI*y* is generated by the first excitation winding and a control magnetic field −NI*y* is generated by the second excitation winding, or alternatively a control magnetic field NI*x* is generated by the third excitation winding and a control magnetic field −NI*x* is generated by the fourth excitation winding.

Since the respective excitation windings are disposed along the axis of the switching element as described above, in case that a particular cross-point is selected to close the corresponding cross-point switch, at the other cross-points aligned on the selected row or column only one of the first and fourth excitation windings which are disposed at positions remote from the contact gap portion of the switching element is energized. Accordingly, the magnetic effect upon the reed of the switching element on its unexcited side by the intermediary of the shunt plate is small, so that the current margin is increased and the stability in operation is improved.

A modification of the above-described electromagnetic switch matrix device can be constructed in such manner that a plurality of rod-shaped iron cores made of semi-hard magnetic material and serving also as fixed switch contacts are arrayed in parallel to each other in a matrix form and have one of their respective end portions sealed in and supported by a sealed vessel made of metal or synthetic resin as electrically insulated therefrom, and that a plurality of armatures serving also as movable switch contacts are disposed opposite to one of the respective end faces of the iron cores at a predetermined distance therefrom and are supported by a row or column signal line conductor via contact springs, this switch contact portion being enclosed in said sealed vessel.

FIG. 12 shows one example of the structure of the electromagnetic switch matrix device as constructed in the above described manner. In this figure, a plurality of rod-shaped iron cores 41 made of semi-hard magnetic material are fixedly supported by a metallic vessel 40 via insulators 42 made of glass or the like. A pulrality of armatures 43 are supported via contact springs 44 by one of back stop members 45 which serve as column signal line conductors in the illustrated example, at a predetermined gap distance from the end faces of said iron cores 41. The back stop members 45 are electrically connected to terminal conductors 46 and 46' which are fixedly supported by the metallic vessel 40 similarly to the iron cores 41. The top of the vessel 40 is sealingly covered by a metallic cap 47.

First, second, third and fourth windings 33 to 36 are wound around the iron cores 41 employing in combination both the individual and common winding methods as illustrated in FIGS. 9 and 10. In more particular, with reference to FIG. 12, the first excitation windings 33 are wound individually around the respective iron cores 41 at a position remote from the top vessel 40, and the second excitation windings 34 are wound individually around the respective iron cores 41 at a position near to the top vessel 40 according to the winding method as illustrated in FIG. 9. On the other hand, the third excitation windings 35 which take the form of elongated loops, are wound in common to and surrounding all the iron cores 41 aligning on the plane of the sheet of the drawing which belong to the respective columns of the switch matrix, as overlapped on the individual second excitation windings 34, and the fourth excitation windings 36 which also take the form of elongated loops, are wound in common to and surrounding all the iron cores 41 which belong to the respective columns as overlapped on the individual excitation windings 33. These first to fourth excitation windings are connected in the row and column control line circuit as described with reference to FIG. 6.

Upon closing a selected cross-point switches disposed in the sealed vessel 40, the second and third excitation windings 34 and 35 are short-circuited by closing the short-circuiting switch S, and the first and fourth excitation windings 33 and 36 are energized to generated control magnetic fields as shown by arrows 13 and 16. Then the iron core 41 located at the selected cross-point is magnetized up to saturated level of magnetization by the additive effect of the control magnetic fields 13 and 16, so that the armature 43 in the sealed vessel 40 is attracted to the iron core 41, and thus the selected column signal line conductor 45 in the vessel 40 and the selected row signal line conductor at the bottom are connected together at the selected cross-point via the armature 43 and the iron core 41 itself. On the other hand, upon releasing the closed switch contacts in the vessel 40, either the first and second excitation windings 33 and 34 are energized to demagnetize the iron core 41 by the opposite control magnetic fields 13 and 14 in combination, or the third and fourth excitation windings 35 and 36 are energized to demagnetize the iron core 41 by the opposite control magnetic field 15 and 16 in combination.

As described in detail above, in the electromagnetic switch matrix device according to the present invention, since closing a switching element located at a particular cross-point only requires energization of the first and fourth excitation windings in the corresponding row and column, respectively, the impedance of the excitation windings to be driven can be made small, and so the driving electric power can be reduced. In addition, in any case since the excitation windings disposed at the respective cross-points are energized by passing a current I through the same number of turns N only, the maximum magnetomotive force generated by each winding is as small as NI, and accordingly, the magnetic interference acting upon the adjacent cross-points is small. Therefore, the pitch of the cross-point array in the switch matrix can be made small, and so the size of the switch matrix device can be reduced. In addition, a multiple connection which has been heretofore considered difficult, can be easily realized. Furthermore, in case of selectively actuating a particular cross-point, at the other cross-points associated with the selected row and column, only one of the first and fourth excitation windings which are disposed at positions remote from the contact gap portion of the switching element, is energized, so that the magnetic effect upon the reed of the switching element on the unexcited side is small, and therefore, there is an advantage that the current margin is increased and the stability in operation can be enhanced.

Finally, it is to be noted that according to the inventive concept of the present invention it is immaterial whether the first to fourth excitation windings are individually wound around the respective switching elements as shown in FIG. 9 and serially connected as shown in FIG. 6 or they are wound in common to all the switching elements belonging to the respective rows or columns as shown in FIG. 10. Even a combined individual and common winding method can be realized as explained with reference to FIG. 12. Therefore, in the appended claims and in the section of general description in this specification, the terms of "first winding means", "second winding means", "third winding means" and "fourth winding means" shall be interpreted to represent both the series connection of individually wound excitation windings and the commonly wound excitation winding coresponding to each row or each column.

Since many changes could be made in the above construction and many apparently widely different embodiments of this invention could be made without departing from the scope thereof, it is intended that all the matter contained in the above description or shown in the accompanying drawings shall be interpreted as illustrative and not as a limitation to the scope of the invention.

What is claimed is:

1. An electromagnetic switch matrix device comprising a plurality of row signal lines; a plurality of column signal lines intersecting substantially at right angles to said row single lines; a plurality of electromagnetic switching elements disposed at the respective cross-points between said row and column signal lines so as to bridge the corresponding row and column signal lines when their contact points are electromagnetically closed; first, second, third and fourth winding means wound around said electromagnetic switching elements so as to generate control magnetic fields for controlling the operations of the respective switching elements; a plurality of row control lines corresponding to said respective row signal lines, each of which includes said first winding means for generating the control magnetic fields in common to all the cross-points aligned on the corresponding row as well as said second winding means for generating the control magnetic fields in common to all the cross-points aligned on the corresponding row; a plurality of column control lines corresponding to said respective column signal lines, each of which includes said third winding means for generating the control magnetic fields in common to all the cross-points aligned on the corresponding column as well as said fourth winding means for generating the control magnetic fields in common to all the cross-points aligned on the corresponding column; and means for selectively short-circuiting said second winding means and said third winding means at least in a selected row control line and in a selected column control line, respectively; the polarity of said first, second, third, and fourth winding means being such that when a predetermined polarity of current pulse is passed through said row and column control lines, said second and third winding means may generate control magnetic fields in the opposite direction to that generated by said first winding means, while said fourth winding means may generate a control magnetic field in the same direction as that generated by said first winding means.

2. An electromagnetic switch matrix device according to claim 1, which comprises a magnetic core disposed at each cross-point in magnetically coupled relationship to said switching element, said magnetic core being easily reversible in magnetization and capable of retaining residual magnetization.

3. An electromagnetic switch matrix device according to claim 1, in which said switching element has a magnetic self-holding function.

4. An electromagnetic switch matrix device according to claim 1, in which said first, second, third and fourth winding means have substantially the same number of turns.

5. An electromagnetic switch matrix device according to claim 1, in which said selective short-circuiting means comprises means for commonly connecting one ends of all the row control lines having connected thereto said second winding means and one ends of all the column control lines having connected thereto said third winding means, a first set of properly directed diodes each having one end connected to a junction between said first winding means and said second winding means in each row control line, a second set of properly directed diodes each having one end connected to a junction between said third winding means and said fourth winding means in each column line, and switching means for selectively connecting the other ends of said first and second sets of properly directed diodes.

6. An electromagnetic switch matrix device according to claim 1, in which said selective short-circuiting means comprises means for commonly connecting one ends of of all the row control lines having connected thereto said second winding means and one ends of all the column control lines having connected thereto said third winding means, a first set of switching means each selectively connecting a junction between said first winding means and said second winding means in each row control line to a common conductor, and a second set of switching means each selectively connecting a junction between said third winding means and said fourth winding means in each column control line to said common conductor.

7. In an electromagnetic switch matrix device including a two-dimensional array of cross-point elements, each of which comprises a magnetically actuated switch adapted to bridge its associated pair of row and column signal lines in response to a current pulse applied to its associated pair of row and column control lines, the improvement comprising:

actuator means including first, second, third and fourth windings associated with each of said magnetically actuated switches, said first and second windings being connected to their associated row control lines and said third and fourth windings being connected to their associated column control lines, said row and column control lines being connected at their one ends to a common point; and means for short-circuiting said second and third windings of each actuator means whereby only the actuator means located at the intersection of said selected pair of row and column control lines produces a magnetic field sufficient to actuate its associated magnetically actuated switch.

8. The device according to claim 7, wherein each of said magnetically actuated switches has a pair of contact members made of semi-hard magnetic material and adapted to close and open under the influence of the magnetic fields produced by said actuator means.

9. The device according to claim 7, wherein said actuator means includes a magnetic core made of semi-hard magnetic material and having provided therearound said first, second, third and fourth windings.

10. The device according to claim 7, wherein said second and third windings of each actuator means are positioned closer to the contact gap of their associated magnetically actuated switch than said first and fourth windings of the same actuator means.

11. The device according to claim 7, wherein each of said first and second windings is in the form of a single loop surrounding all of said magnetically actuated switches arranged in each row, and wherein each of said third and fourth windings is arranged in each column.

12. The device according to claim 7, wherein said short-circuiting means includes means for connecting said row and column control lines of a selected pair at the points between said first and second windings and between said third and fourth windings.

13. The device according to claim 12, wherein said short-circuiting means includes switching means which is closed to connect the points on said row control lines between said first and second windings and the points on said column control lines between said third and fourth windings.

14. The device according to claim 13, wherein said short-circuiting means further icludes a first diode connected between said switching means and each of said row control lines and a second diode connected between said switching means and each of said column control lines.

* * * * *